US008181275B2

(12) United States Patent
Saturnio

(10) Patent No.: US 8,181,275 B2
(45) Date of Patent: May 22, 2012

(54) LACROSSE GLOVE WITH PROTECTIVE ELEMENT

(75) Inventor: Christopher Saturnio, Crofton, MD (US)

(73) Assignee: Wm. T. Burnett IP, LLP, Baltimore, MD (US)

( * ) Notice: Subject to any disclaimer, the term of this patent is extended or adjusted under 35 U.S.C. 154(b) by 933 days.

(21) Appl. No.: 12/143,493

(22) Filed: Jun. 20, 2008

(65) Prior Publication Data

US 2008/0313786 A1 Dec. 25, 2008

Related U.S. Application Data

(60) Provisional application No. 60/945,435, filed on Jun. 21, 2007.

(51) Int. Cl.
*A41D 19/00* (2006.01)

(52) U.S. Cl. ..... 2/161.1; 2/16

(58) Field of Classification Search ..... 2/16, 20, 2/161.1, 161.6, 163
See application file for complete search history.

(56) References Cited

U.S. PATENT DOCUMENTS

| | | | | |
|---|---|---|---|---|
| 1,951,190 | A * | 3/1934 | Gambee | 2/21 |
| 4,272,849 | A * | 6/1981 | Thurston et al. | 2/16 |
| 5,237,703 | A * | 8/1993 | Brine et al. | 2/16 |
| 5,884,329 | A | 3/1999 | Goldsmith et al. | |
| 5,963,985 | A | 10/1999 | Behr et al. | |
| 5,996,117 | A | 12/1999 | Goldsmith et al. | |
| 6,543,057 | B2 | 4/2003 | Beland et al. | |
| 6,584,615 | B1 | 7/2003 | Wilder et al. | |
| 6,643,844 | B2 | 11/2003 | Morrow et al. | |
| 6,732,376 | B2 | 5/2004 | Hoffman | |
| 7,574,748 | B2 * | 8/2009 | Fisher et al. | 2/16 |
| 7,784,110 | B2 * | 8/2010 | Jourde et al. | 2/161.1 |
| 2006/0010552 | A1 * | 1/2006 | Gait | 2/16 |
| 2007/0028354 | A1 * | 2/2007 | Hochmuth | 2/161.1 |

* cited by examiner

*Primary Examiner* — Katherine Moran
(74) *Attorney, Agent, or Firm* — Ober, Kaler, Grimes & Shriver; Royal W. Craig

(57) ABSTRACT

An embodiment of the present invention provides a lacrosse glove having a rigid protective element extending over and secured to the padding disposed on the back side of the thumb receiving portion of the glove. The protective element comprises a protective thumb portion that extends from proximate to a tip of the thumb receiving portion to a base region of the thumb receiving portion, and a protective transverse portion that extends in a direction generally perpendicular to the protective thumb portion from the base region of the thumb receiving portion toward a center portion of the glove.

7 Claims, 9 Drawing Sheets

LACROSSE GLOVE WITH PROTECTIVE ELEMENT

This application claims the benefit of U.S. Provisional Application No. 60/945,435, filed Jun. 21, 2007, which is herein incorporated by reference in its entirety.

BACKGROUND

1. Field of the Invention

The present invention relates generally to lacrosse gloves and, more particularly, to lacrosse gloves having a protective element for the thumb and/or metacarpal areas.

2. Background of the Invention

There remains a need in the prior art for lacrosse gloves that protect against injuries due to hyperextension of the thumb.

BRIEF SUMMARY OF THE INVENTION

An embodiment of the present invention provides a lacrosse glove having a rigid protective element extending over and secured to the padding disposed on the back side of the thumb receiving portion of the glove. The protective element comprises a protective thumb portion that extends from proximate to a tip of the thumb receiving portion to a base region of the thumb receiving portion, and a protective transverse portion that extends in a direction generally perpendicular to the protective thumb portion from the base region of the thumb receiving portion toward a center portion of the glove. The rigid protective element is configured to permit flexure of the thumb receiving portion of the glove in a first direction toward the front side of the thumb receiving portion and to restrict flexure of the thumb receiving portion of the glove in a second direction, opposite the first direction, toward the back side of the thumb receiving portion, and to further restrict flexure of the thumb receiving portion of the glove in a third direction, generally perpendicular to both the first and second directions, away from the finger receiving portions.

DETAILED DESCRIPTION OF THE INVENTION

Figure 1:
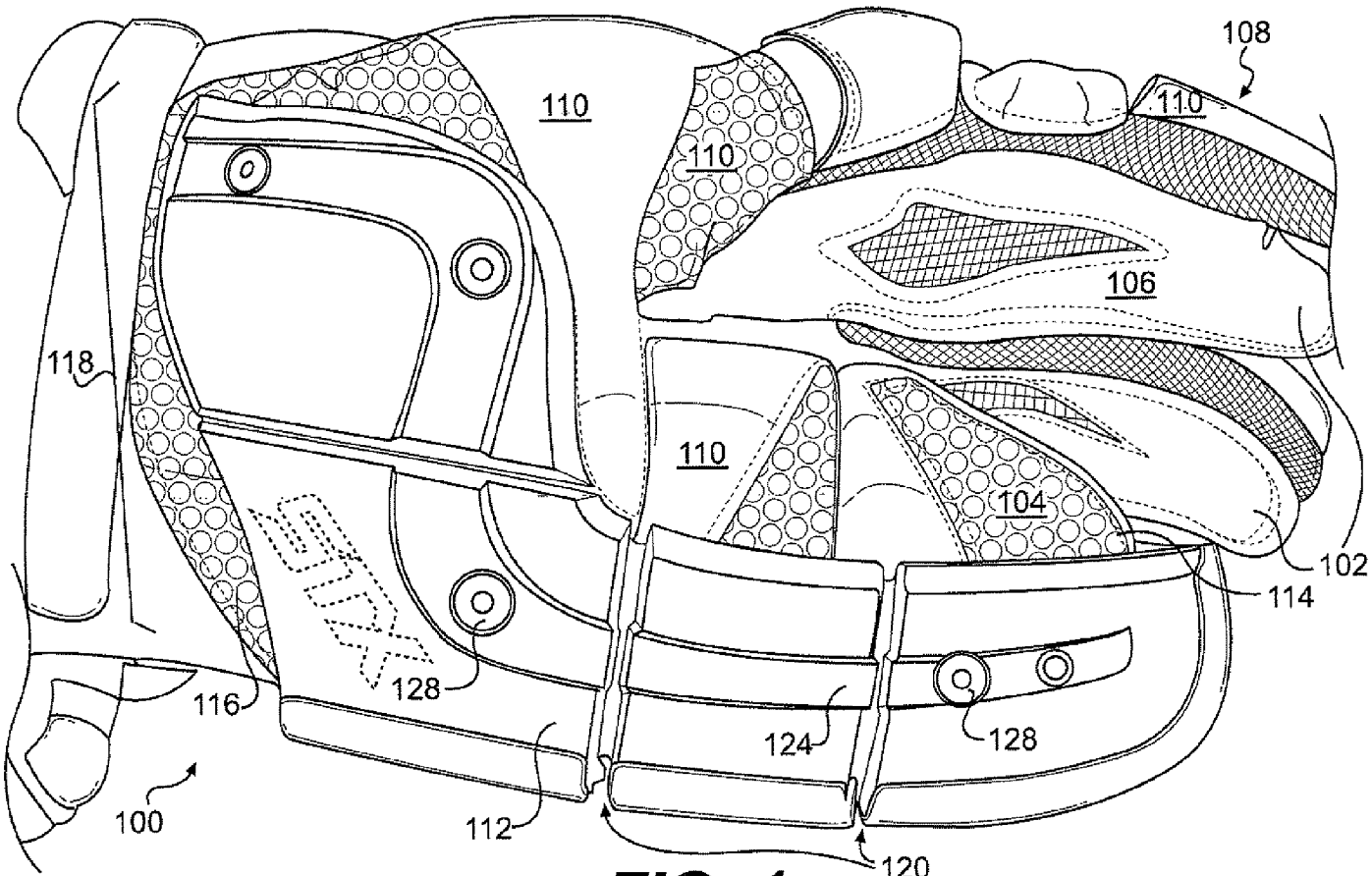
FIG. 1 is a schematic diagram of a lacrosse glove having a protective element in accordance with an embodiment of the present invention.

In accordance with the present invention and with reference to FIG. 1, a lacrosse glove 100 is provided that is configured to prevent non-natural motion of a thumb receiving portion so as to protect against hyperextension of a player's thumb and to prevent metacarpal or other injury. The lacrosse glove 100 includes finger receiving portions 102 and a thumb receiving portion 104 for receipt of a player's hand. The side of the glove 100 that covers a player's palm will be referred to herein as the front side 106, and the side of the glove 100 that covers a player's back-hand will be referred to herein as the back side 108. The glove 100 in accordance with the present invention further includes padding 110 disposed at least on the back side 108 of the glove 100 in order to provide general protection against strikes and blows to the player's hand. Further provisions described below protect against hyperextension of the thumb and metacarpal injury.

In one embodiment, as shown in FIG. 1, a rigid protective element 112 extends over and is secured to the padding 110 that is disposed on the back side of the thumb receiving portion 104 of the glove 100. This protective element 112 may extend from proximate to a tip 114 to a base region 116 of the thumb receiving portion 104 of the glove 100. The base region 116 of the thumb receiving portion 104 may refer to the general area of the glove where the thumb receiving portion 104 joins with the rest of the glove 100 and generally coincides with the location of the first metacarpal bone (i.e., of the thumb) when the glove 100 is on a player's hand.

Figure 2A:
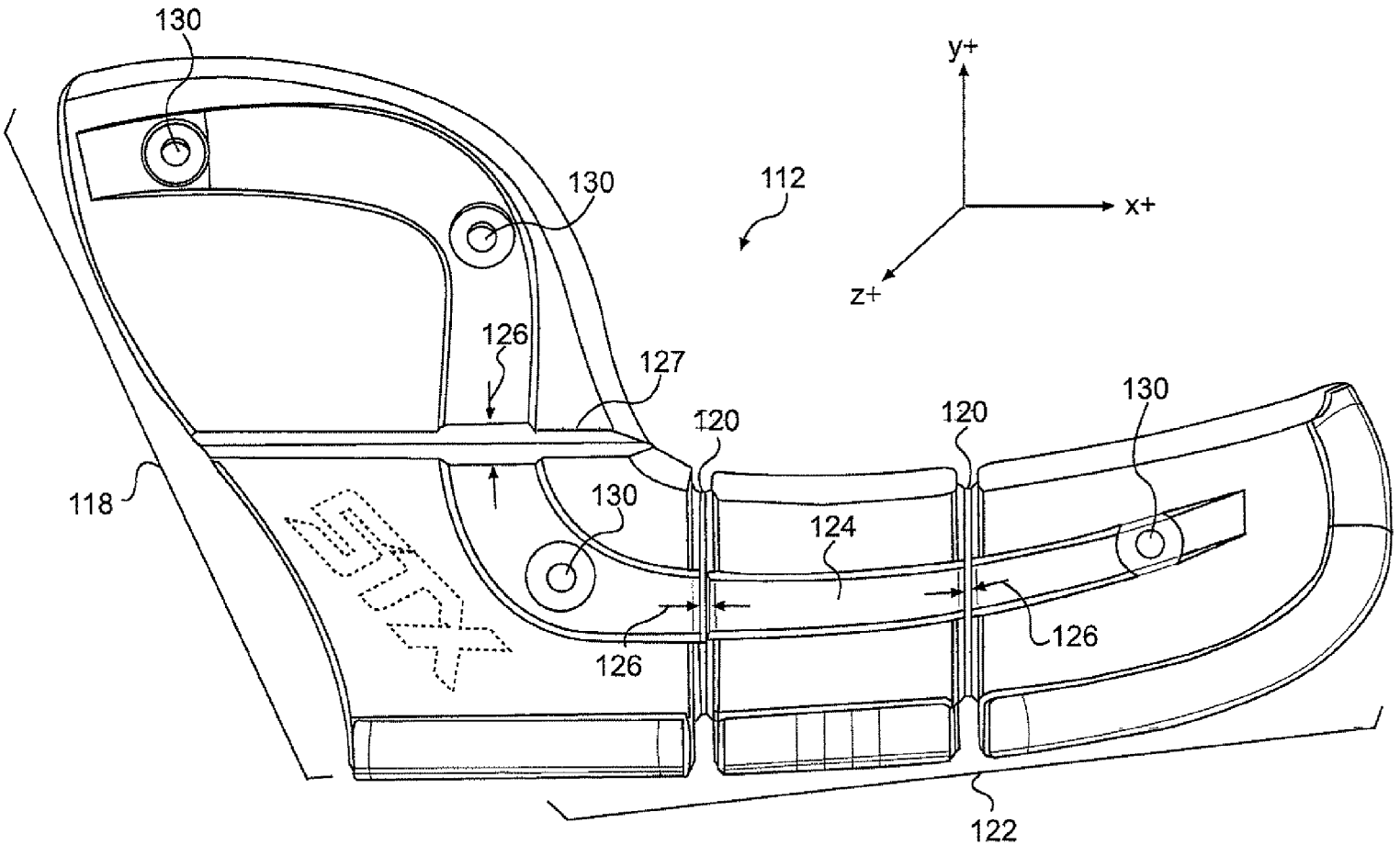
FIG. 2A is a schematic diagram of a protective element in accordance with an embodiment of the present invention.

As additionally shown in FIG. 2A, the protective element 112 may also have a transverse portion 118 extending from the base region 116 of the thumb receiving portion 104 toward the center portion of the glove 100 to generally cover the metacarpal region of a player's hand. Thus, the protective element 112 may include a longitudinally extending protective thumb portion 122 extending generally along the length of the thumb receiving portion 104 as well as the transverse portion 118 extending generally perpendicularly to the thumb portion 122. In this manner, the protective element 112 in accordance with the present invention protects the thumb from hyperextension in multiple directions and also prevents injury to the metacarpal bones due to such movement by providing a rigid structure.

Protective element 112 limits movement or flexure of the thumb in one or more directions. Movements described herein are made with reference to the x-y-z coordinate system shown in FIG. 2A. One of skill in the art will appreciate that the coordinate system is provided merely for illustrative purposes and rotations or movements about a specified axis are general directions and not meant to be limited to a strictly delineated range.

For example, movement may be permitted in a direction toward the front side 106 of the glove 100 (i.e., rotation of the tip of thumb portion 122 generally about the y-axis in the negative z direction, for example, in a motion that curls the thumb under the fingers and palm) and be restricted in the opposite direction toward the back side 108 (i.e., rotation of the tip of the thumb portion 122 about the y-axis in the positive z direction, for example, in a motion that extends the thumb away from the fingers). For this purpose, a hinge 120 or plurality of hinges 120 may be provided on the protective element 112. The hinges 120 may be of the living hinge type, wherein a portion of the protective element 112 is formed of a thin material to allow flexure.

These living hinges offer the unexpected benefits of lighter weight, increased durability, fewer moving parts, and a single, integral, inexpensive construction (e.g., the protective element 122 can be a unitary piece). This living hinge construction also enables the protective element 112 to be secured to the top of the thumb receiving portion 104 of the glove 100. Surfaces of the protective element 112 that are adjacent to the thin material hinge portions 120 may be configured to abut each other when the protective element 112 is bent, upon flexure of the thumb receiving portion 104, beyond a predetermined amount so as to restrict any further movement.

Movement or flexure may also be controlled in a second direction. The protective element 112 may be provided with a further hinge 127 that allows rotation about the x-axis. Accordingly, any range of motion is permitted for the thumb portion 122 to rotate toward the front side 106 (i.e., about the x-axis in the negative z-direction, for example, in a motion rolling the thumb under the finger and palms by rotation of the carpometacarpal joint) while rotation is limited in the direction toward the back side 108 (i.e., about the x-axis in the positive z direction) by virtue of the edges of the hinge 127 (or the surfaces of the rib 124) coming into contact with each other when the thumb portion 122 is flexed in that direction.

Figure 2C:
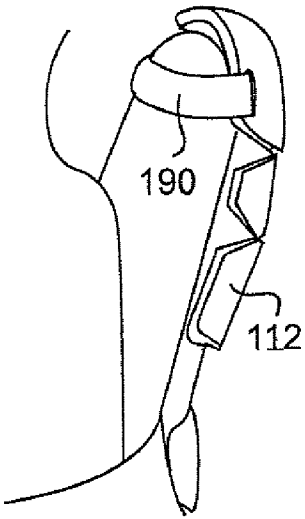
FIG. 2C is a schematic diagram of a protective element secured to a glove with a strap around the tip of the thumb and protective element for added stability, according to an embodiment of the present invention.
Figure 2B:
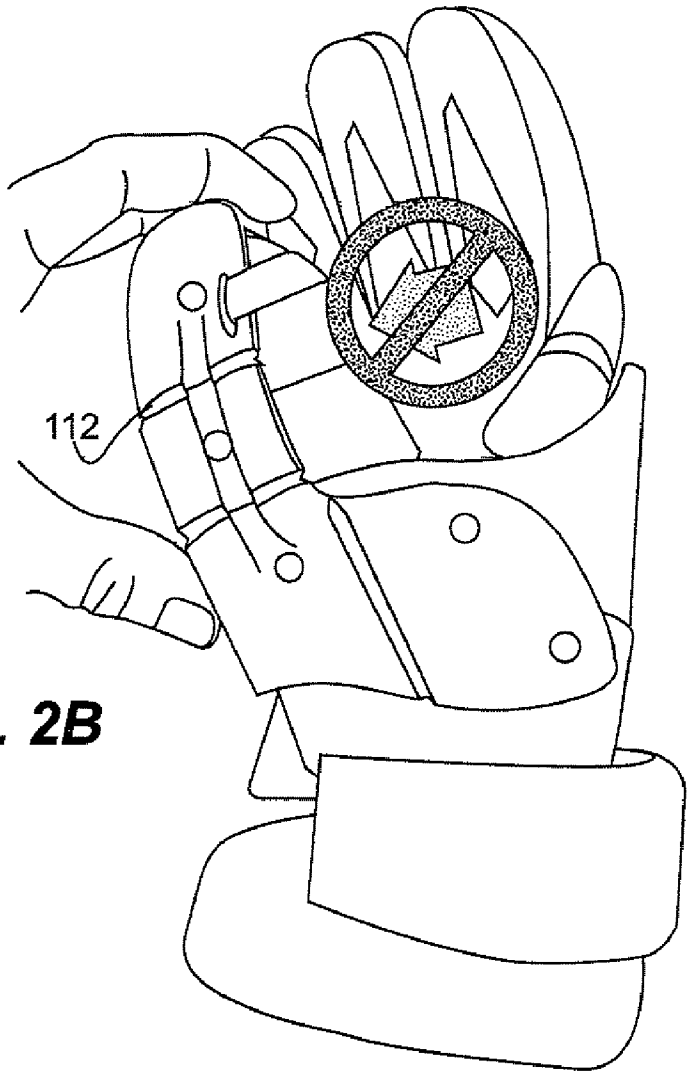
FIG. 2B is a schematic diagram showing a protective element resisting an outward movement of the thumb, according to an embodiment of the present invention.

Protective element 112 may also resist a force applied to thumb portion 122 generally in the y-direction shown in FIG. 2A, away from the glove and the transverse portion 118. FIG. 2B illustrates this feature in more detail. As shown, protective element 112 resists outward movement of the thumb (in the direction of the crossed-out arrow), thereby reducing the chance of injury to the carpometacarpal joint that connects the first metacarpal (base of the thumb bone) to the trapezium bone at the lower based of the thumb. In a further embodiment, as shown in FIG. 2C, the protective element 112 can be secured to a glove with an additional strap 190 that wraps around the tip of the thumb and protective element 112 for added stability.

The protective element 112 having living hinges 120 may further comprise a rib portion 124 that extends generally along the protective element 112. That is, the rib 124 may have a first portion that extends along the surface of the thumb portion 122 and a second portion that extends along the surface of the transverse portion 118. The rib portion 124 may have gaps 126 that coincide with the hinge portions 120. Surfaces of the rib portion 124 adjacent to the gaps 126 may be configured to come into contact with each other when the protective element 112 is bent, upon flexure of the thumb receiving portion 104, beyond a predetermined amount so as to restrict any further movement. In one embodiment, the surfaces of the rib portion adjacent the gaps are configured to come into contact with each other prior to contact between adjacent edges of the hinges.

Fasteners 128 (see FIG. 1) may be used to secure the protective element 112 to the padding 110 of the glove 100. The fasteners 128 may be any suitable mechanism, such as, for example, rivets, screws, and glue, and may be inserted through the protective element 112 through holes 130. Coinciding holes may be provided or formed in the padding or other part of the glove for attachment of the protective element 112. For increased strength characteristics, in some embodiments the fasteners 128 may be inserted through the rib portion 124 of the protective element 112, as shown in FIGS. 1 and 2.

Aside from living hinges 120, various other arrangements may be provided in accordance with the present invention to limit flexure of the thumb receiving portion 104.

Figure 3:
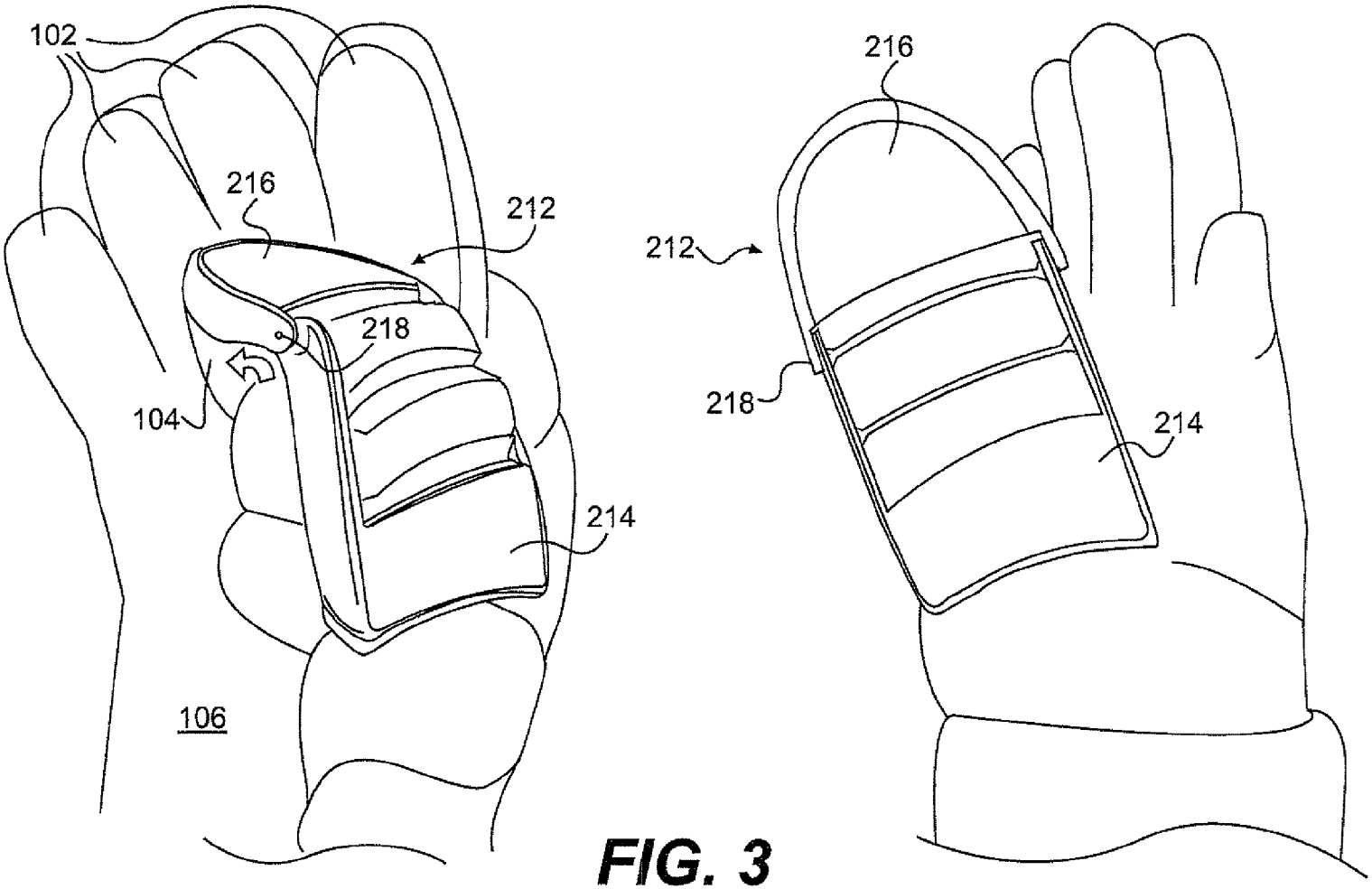
FIG. 3 is a schematic diagram of a protective element with pivoting members, shown in two different positions, in accordance with another embodiment of the present invention.

As shown in FIG. 3, a protective element 212 in accordance with another embodiment may be divided into a first base portion 214 and a second tip portion 216 that are connected by a pin hinge 218 at the joint thereof. The structure of the protective element 212 at the joint may be configured to allow limited rotation so as to prevent the thumb receiving portion 104 from flexing beyond a predetermined amount toward the back of the glove 100. First base portion 214 is attached at the base of the thumb to prevent side movement. The hinged joint 218 between the first base portion 214 and the second tip portion 216 provide flexibility and protection.

Figure 4:
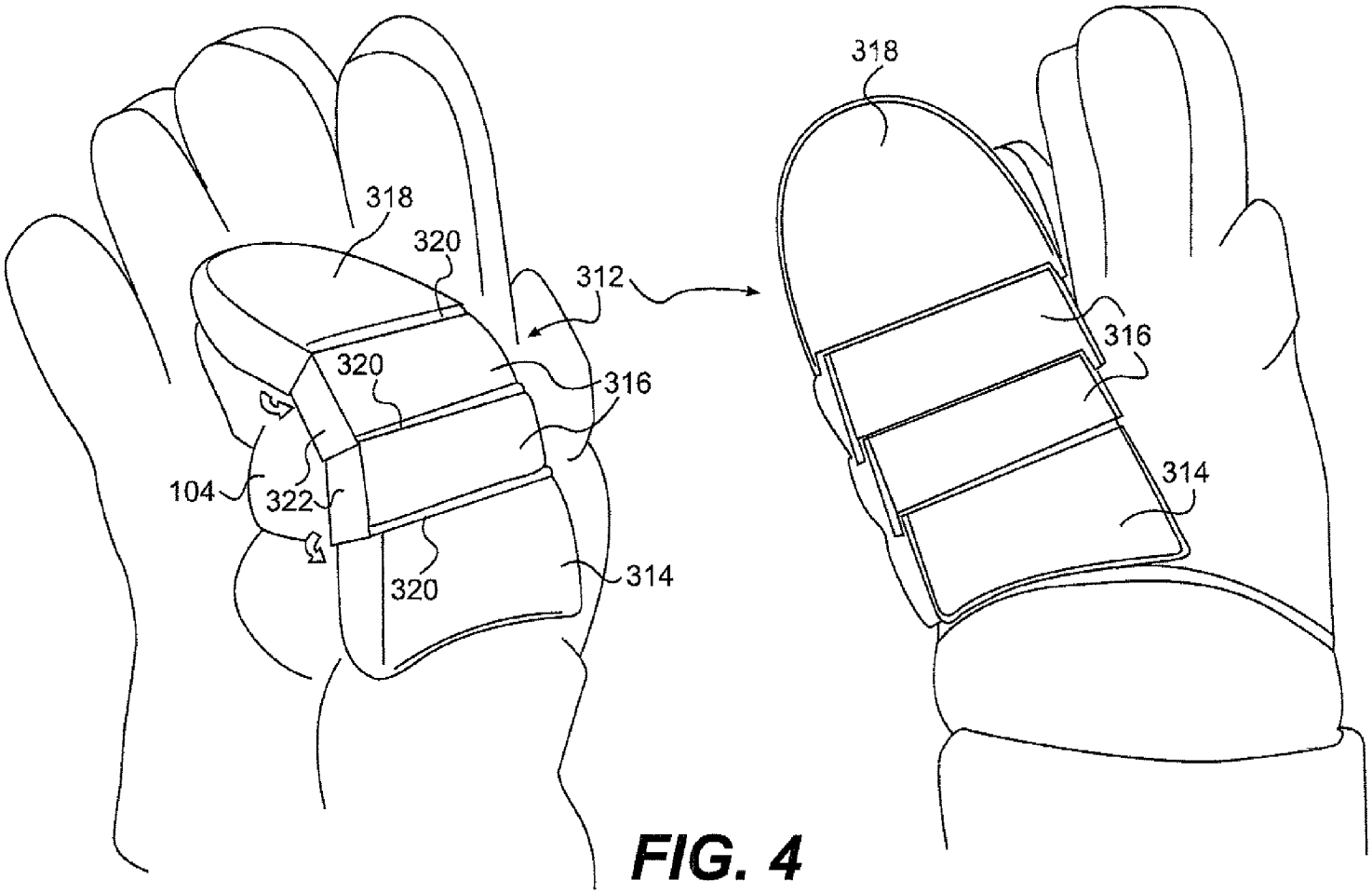
FIG. 4 is a schematic diagram of a protective element with segmented members, shown in two different positions, in accordance with another embodiment of the present invention.

As shown in FIG. 4, a protective element 312 in accordance with another embodiment of the present invention may be segmented into a plurality of plate-like members 314, 316, 318. The members may include a base member 314, middle members 316, and a tip member 318 that protects the tip of the thumb. The plate-like members 314, 316, 318 overlap at side portions 322 to prevent side movement as well as flexing of the thumb receiving portion 104 beyond a predetermined amount toward the back of the glove 100. The members 314, 316, 318 may be joined by hinges 320 to remain flexible and allow controlled motion of the thumb receiving portion 104.

Figure 5:
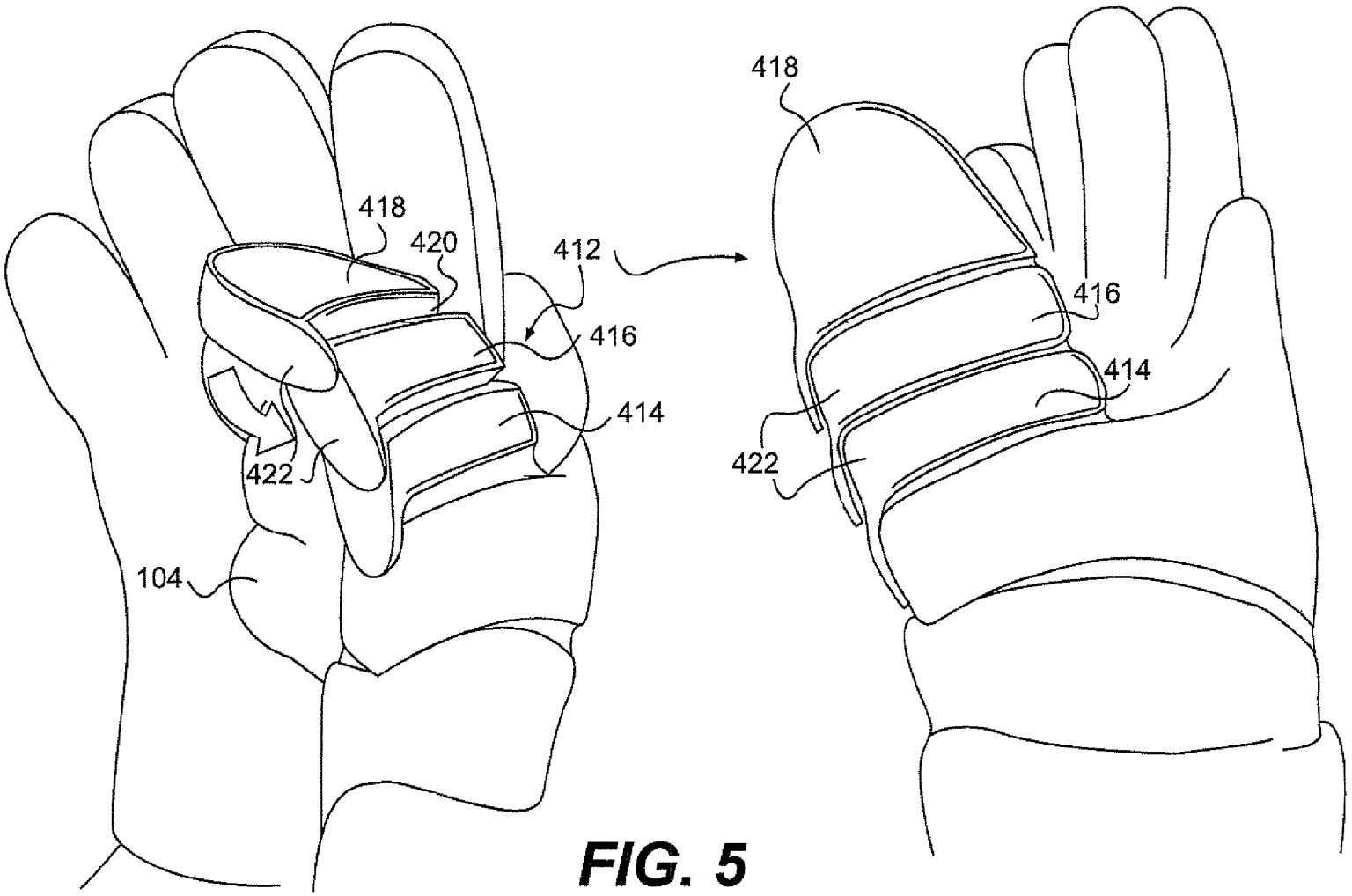
FIG. 5 is a schematic diagram of a protective element with segmented members with side extensions, shown in two different positions, in accordance with another embodiment of the present invention.

As shown in FIG. 5, which is a variation of the embodiment shown in FIG. 4, a protective element 412 in accordance with the present invention may be segmented into a plurality of plate-like members 414, 416, 418 further having extensions 422 on an outer portion of the protective element 412. The extensions 422 may aid in further restricting side movement and flexure of the thumb receiving portion 104 of the glove 100.

Figure 6:
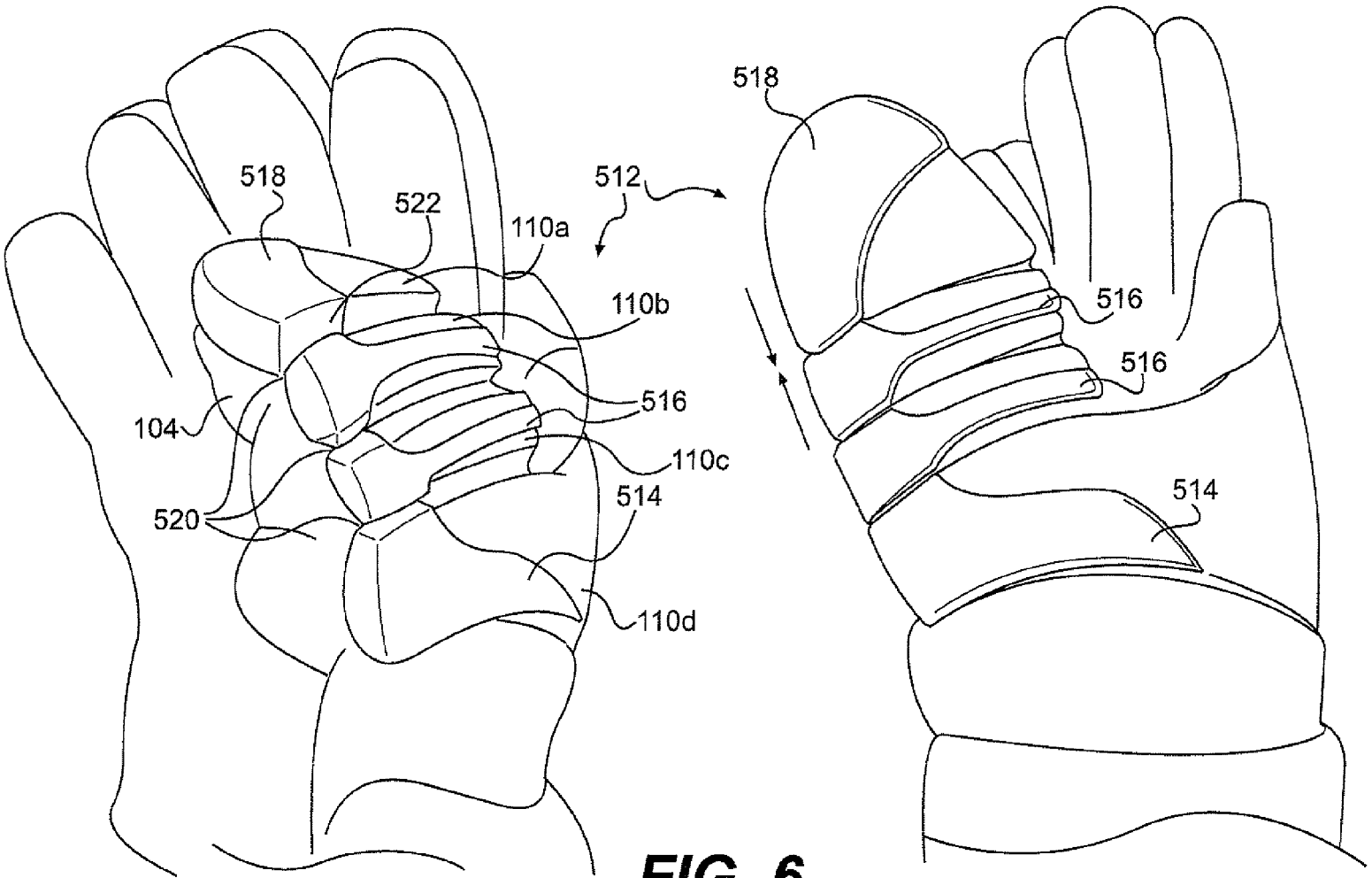
FIG. 6 is a schematic diagram of a protective element with members coinciding with portions of glove padding, shown in two different positions, in accordance with another embodiment of the present invention.

As shown in FIG. 6, in accordance with a further embodiment of the present invention, the padding 110 on the back side of the thumb receiving element 104 may be separated into portions 110*a-d* that allow for forward bending of the thumb receiving element 104. Over each of the padding portions 110*a-d*, portions of a protective element 512 may be provided so that the protective element 512 is configured to flex at the same locations 520 as the padding portions 110*a-d*. Adjacent surfaces 522 of the protective element 512 may be configured to restrict flexure of the thumb receiving portion 104 beyond a predetermined amount. The rigid exoskeleton of portions 110*a-d* allows flexibility for natural movements, while also locking the thumb portion 122 in a straight position to prevent hyperextension.

Figure 7:
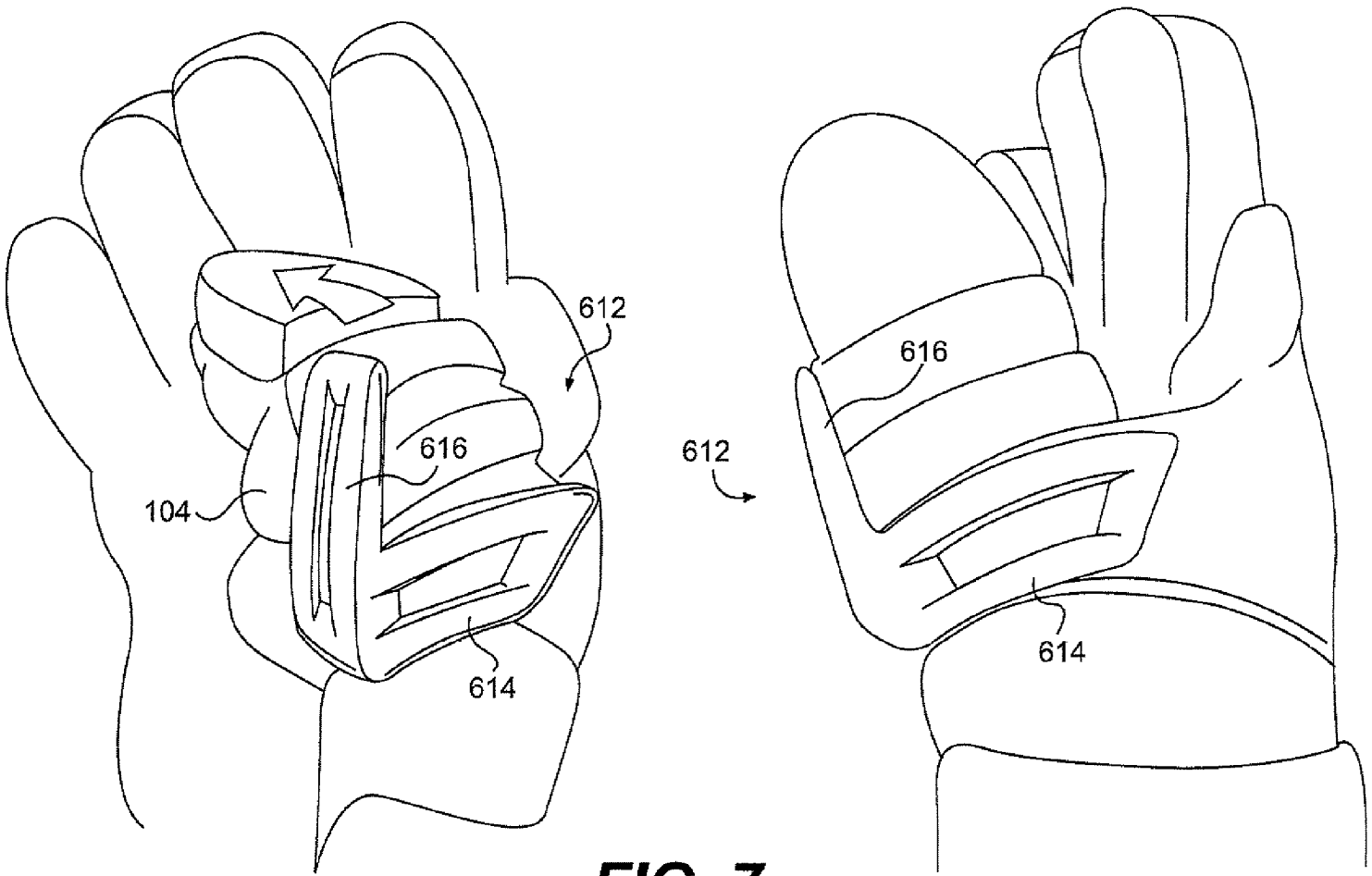
FIG. 7 is a schematic diagram of a protective element having a brace, shown in two different positions, in accordance with another embodiment of the present invention.

As shown in FIG. 7, a protective element 612 in accordance with an embodiment of the present invention may be provided in the form of a brace in order to restrict sideward and backward motion of the thumb receiving element 104. The brace may comprise a longitudinally extending portion 616 generally along the outward side of the thumb receiving portion 104 and a transverse portion 614 generally extending across the thumb receiving element 104. Protective element 612 allows the thumb portion 122 to move in natural directions, while also supporting the outside of the thumb and preventing the thumb portion 122 from bending outwards. In one embodiment, protective element 612 is added onto an existing glove, rather than being integrally manufactured with the glove.

Figure 8:
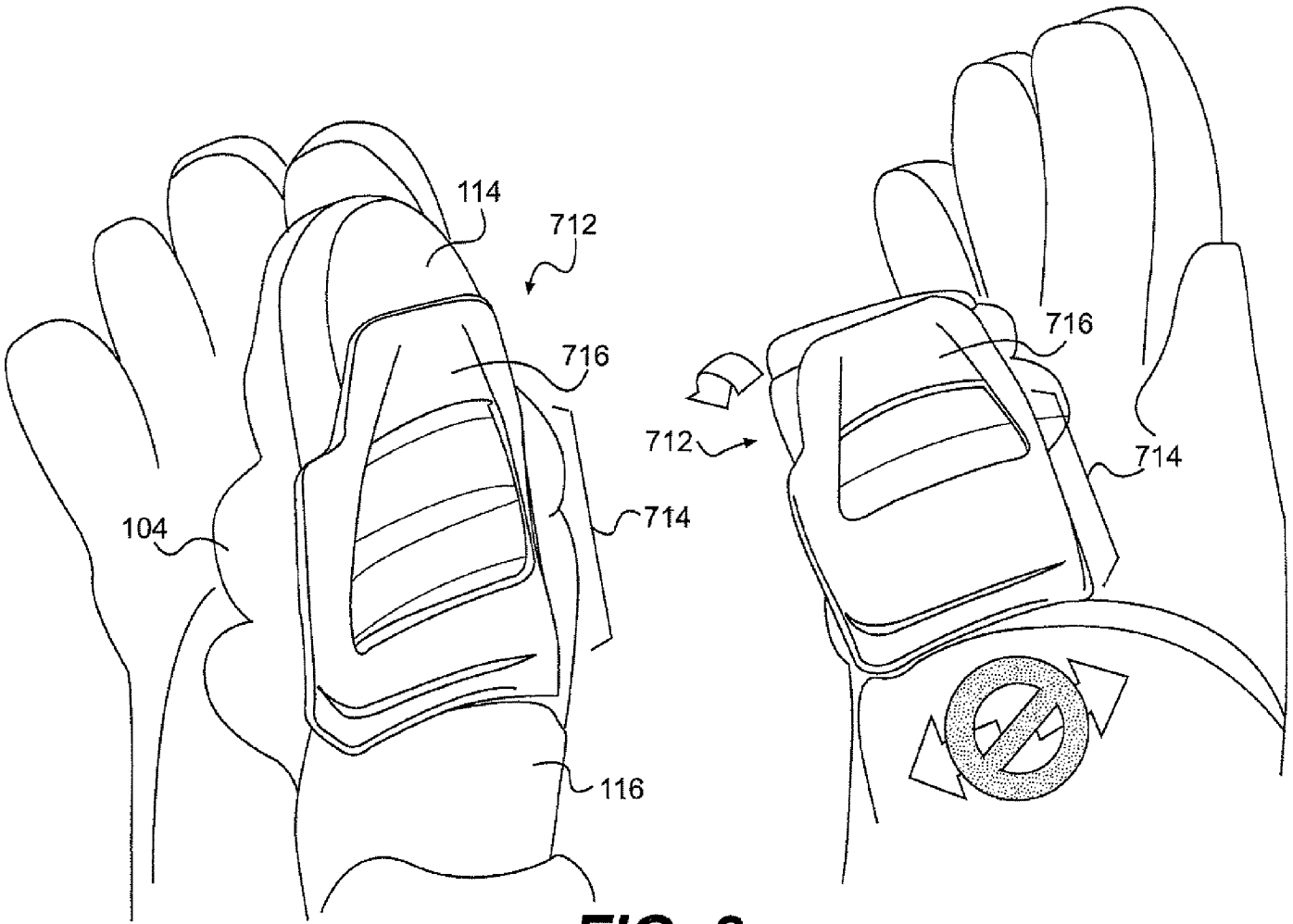
FIG. 8 is a schematic diagram of a protective element having a brace with an extension member, shown in two different positions, in accordance with a further embodiment of the present invention.

As shown in FIG. 8, a protective element 712 may be provided in the form of a brace portion 714 that is connected to a base portion 116 of the thumb receiving portion 104 and includes an extension member 716 that extends toward the tip 114 of the thumb receiving portion 104. Wile the brace 714 is secured to the padding 110 on the thumb receiving portion 104, the extension member 716 or a portion thereof is not secured to the tip portion 114 of the thumb receiving element 104. Accordingly, flexure of the thumb receiving portion 104 is permitted in the forward direction since the extension member 716 is not connected to the tip 114 of the thumb receiving portion 104 while flexure is limited in the backward direction by virtue of the extension member 716 coming into contact with the tip 114 of the thumb receiving portion 104 when it is in a generally straight orientation. The protective element 712 prevents side to side movements. In addition, in one embodiment, protective element 712 is added onto an existing glove, rather than being integrally manufactured with the glove.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A lacrosse glove, comprising:

a plurality of finger receiving portions;

a thumb receiving portion;

padding disposed on a back side of the finger receiving portions and the thumb receiving portion; and a rigid protective element extending over and secured to the padding disposed on the back side of the thumb receiving portion, the rigid protective element comprising a protective thumb portion that extends from proximate to a tip of the thumb receiving portion to a base region of the thumb receiving portion, the protective element further comprising a protective transverse portion that extends in a direction generally perpendicular to the protective thumb portion from the base region of the thumb receiving portion toward a center portion of the glove;

wherein the rigid protective element is configured to permit flexure of the thumb receiving portion of the glove in a first direction toward a front side of the thumb receiving portion and to restrict flexure of the thumb receiving portion of the glove in a second direction, opposite the first direction, toward the back side of the thumb receiving portion, and to further restrict flexure of the thumb receiving portion of the glove in a third direction, generally perpendicular to both the first and second directions, away from the finger receiving portions;

wherein the rigid protective element comprises a plurality of living hinges to permit the flexure of the thumb receiving portion, and a rib portion extending generally along the protective element and having gaps at the locations of the living hinges, surfaces of the rib portion adjacent the gaps being configured to come into contact with each other when the thumb receiving portion is moved in a direction toward the back side such that flexure is restricted.

2. The lacrosse glove of claim 1, wherein the surfaces of the rib portion adjacent the gaps are configured to come into contact with each other prior to contact between adjacent edges of the hinges.

3. The lacrosse glove of claim 1, wherein the rigid protective element is fastened to the padding by fasteners extending through the rib portion.

4. The lacrosse glove of claim 3, further comprising a strap attached to the protective element proximate to the tip of the thumb receiving portion and wrapped around the thumb receiving portion.

5. A lacrosse glove, comprising:

a plurality of finger receiving portions;

a thumb receiving portion;

padding disposed on a back side of the finger receiving portions and the thumb receiving portion; and a rigid protective element extending over and secured to the padding disposed on the back side of the thumb receiving portion, the rigid protective element comprising a protective thumb portion that extends from proximate to a tip of the thumb receiving portion to a base region of the thumb receiving portion, the protective element further comprising a protective transverse portion that extends in a direction generally perpendicular to the protective thumb portion from the base region of the thumb receiving portion toward a center portion of the glove;

wherein the rigid protective element is configured to permit flexure of the thumb receiving portion of the glove in a first direction toward a front side of the thumb receiving portion and to restrict flexure of the thumb receiving portion of the glove in a second direction, opposite the first direction, toward the back side of the thumb receiving portion, and to further restrict flexure of the thumb receiving portion of the glove in a third direction, generally perpendicular to both the first and second directions, away from the finger receiving portions;

wherein the rigid protective element comprises a plurality of living hinges to permit the flexure of the thumb receiving portion, the plurality of living hinges including a first set of living hinges to permit limited rotation in the first direction, and one or more further living hinges to permit limited rotation in another direction.

6. A lacrosse glove comprising:

a plurality of finger receiving portions;

a thumb receiving portion;

padding disposed on a back side of the finger receiving portions and the thumb receiving portion; and a rigid protective element extending over and secured to the padding disposed on the back side of the thumb receiving portion, the rigid protective element comprising a protective thumb portion that extends from proximate to a tip of the thumb receiving portion to a base region of the thumb receiving portion;

wherein the rigid protective element is configured to permit flexure of the thumb receiving portion of the glove in a first direction toward the front side of the thumb receiving portion and to restrict flexure of the thumb receiving portion of the glove in a second direction, opposite the first direction, toward the back side of the thumb receiving portion;

wherein said protective thumb portion comprises at least three segmented components that overlap and are hinged together, the segmented components being configured to allow movement of the thumb receiving portion of the glove in the first direction and the overlapped portions of segmented components being configured to restrict motion of the thumb receiving portion in the second direction, the segmented portions including extensions on lateral sides thereof, the extensions being configured to overlap adjacent segmented portions to restrict motion of the thumb receiving portion in the second direction.

7. A lacrosse glove comprising:

a plurality of finger receiving portions;

a thumb receiving portion;

padding disposed on a back side of the finger receiving portions and the thumb receiving portion; and a rigid protective element extending over and secured to the padding disposed on the back side of the thumb receiving portion, the rigid protective element comprising a protective thumb portion that extends from proximate to a tip of the thumb receiving portion to a base region of the thumb receiving portion;

wherein the rigid protective element is configured to permit flexure of the thumb receiving portion of the glove in a first direction toward the front side of the thumb receiving portion and to restrict flexure of the thumb receiving portion of the glove in a second direction, opposite the first direction, toward the back side of the thumb receiving portion;

wherein the protective thumb portion comprises a base portion and an extension member extending from the base portion toward the tip of the thumb receiving portion, the base portion being secured to padding on the thumb receiving portion while the extension member is fixedly secured only to the base portion, the extension member being configured to be free from contact with said tip of the thumb receiving portion when the thumb receiving portion moves a predetermined distance in the first direction and to come into contact with said tip of the thumb receiving portion when the thumb receiving portion moves a predetermined distance in the second direction and thereby restrict movement of the thumb receiving portion in the second direction beyond a predetermined amount.

* * * * *